US010411411B2

(12) United States Patent
Tang et al.

(10) Patent No.: US 10,411,411 B2
(45) Date of Patent: Sep. 10, 2019

(54) ELECTRICAL CONNECTOR HAVING EMBEDDED GROUNDING MECHANISM

(71) Applicant: FOXCONN INTERCONNECT TECHNOLOGY LIMITED, Grand Cayman (KY)

(72) Inventors: Wen-Jun Tang, Kunshan (CN); Xiao-Qin Zheng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/116,850

(22) Filed: Aug. 29, 2018

(65) Prior Publication Data

US 2019/0067876 A1 Feb. 28, 2019

(30) Foreign Application Priority Data

Aug. 29, 2017 (CN) ..... 2017 1 0758439

(51) Int. Cl.

| | |
|---|---|
| ***H01R 12/00*** | (2006.01) |
| ***H01R 13/6471*** | (2011.01) |
| ***H01R 12/72*** | (2011.01) |
| ***H01R 12/77*** | (2011.01) |
| ***H01R 13/6587*** | (2011.01) |
| ***H01R 43/02*** | (2006.01) |
| ***H01R 13/6582*** | (2011.01) |
| ***H01R 13/6599*** | (2011.01) |
| *H01R 12/71* | (2011.01) |

(52) U.S. Cl.

CPC ..... *H01R 13/6471* (2013.01); *H01R 12/727* (2013.01); *H01R 12/775* (2013.01); *H01R 13/6582* (2013.01); *H01R 13/6587* (2013.01); *H01R 13/6599* (2013.01); *H01R 43/0256* (2013.01); *H01R 12/716* (2013.01)

(58) Field of Classification Search

CPC ..... H01R 23/7073; H01R 13/6275; H01R 23/7026; H01R 23/7057; H01R 13/65802

USPC ..... 439/79, 358, 567, 571, 572, 607

See application file for complete search history.

(56) References Cited

U.S. PATENT DOCUMENTS 5,125,853 A * 6/1992 Hashiguchi ..... H01R 12/7047 439/607.26

5,453,016 A * 9/1995 Clark ..... H01R 43/205 439/79

(Continued)

FOREIGN PATENT DOCUMENTS

CN 202585857 U 12/2012

*Primary Examiner* — Phuong Chi T Nguyen

(74) *Attorney, Agent, or Firm* — Wei Te Chung; Ming Chieh Chang

(57) ABSTRACT

An electrical connector includes an insulative housing forming a mating slot, and the contact module assembled thereto. The contact module includes the insulator and the contacts secured thereto. The insulator is secured to the housing. The contact includes a retaining section secured to the insulator, a contact section extending from one end of the retaining section into a mating slot, a soldering section extending from the other end of the retaining section out of the housing. The contacts include the signal contacts and the grounding contacts. Each contact module further includes at least one conductive plastic block mechanically and electrically connected to the corresponding grounding contacts.

15 Claims, 11 Drawing Sheets

(56) References Cited

U.S. PATENT DOCUMENTS

| | | | | | |
|---|---|---|---|---|---|
| 5,580,269 | A * | 12/1996 | Fan | H01R 12/716 | 439/79 |
| 5,676,554 | A * | 10/1997 | Tsuji | H01R 12/7005 | 439/79 |
| 6,540,559 | B1 * | 4/2003 | Kemmick | H01R 23/688 | 439/108 |
| 6,604,952 | B2 * | 8/2003 | Miwa | H01R 13/506 | 439/79 |
| 9,640,915 | B2 | 5/2017 | Tyco | | |

* cited by examiner

ELECTRICAL CONNECTOR HAVING EMBEDDED GROUNDING MECHANISM

BACKGROUND OF THE DISCLOSURE

1. Field of the Disclosure

The present disclosure relates to an electrical connector, and more particularly to an electrical connector with embedded grounding mechanism.

2. Description of Related Arts

U.S. Pat. No. 9,640,915 discloses a discrete grounding bar assembled to the housing to respectively mechanically and electrically the corresponding grounding contacts. Anyhow, due to the manufacturing tolerance and the environment impact, such grounding effect may not be reliable and stable. China Patent No. CN202585857U discloses using the discrete conductive plastic/polymer disposed in the corresponding cavity of the insulative housing for connecting the corresponding grounding contacts. Anyhow, the whole connector lacks integrity and tends to be disassembled.

An improved electrical connector is desired.

SUMMARY OF THE DISCLOSURE

Accordingly, an object of the present disclosure is to provide an electrical connector with grounding mechanism for enhancing high frequency performance.

To achieve the above object, an electrical connector includes an insulative housing forming a mating slot, and the contact module assembled thereto. The contact module includes the insulator and the contacts secured thereto. The insulator is secured to the housing. The contact includes a retaining section secured to the insulator, a contact section extending from one end of the retaining section into a mating slot, a soldering section extending from the other end of the retaining section out of the housing. The contacts include the signal contacts and the grounding contacts. Each contact module further includes at least one conductive plastic block mechanically and electrically connected to the corresponding grounding contacts.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
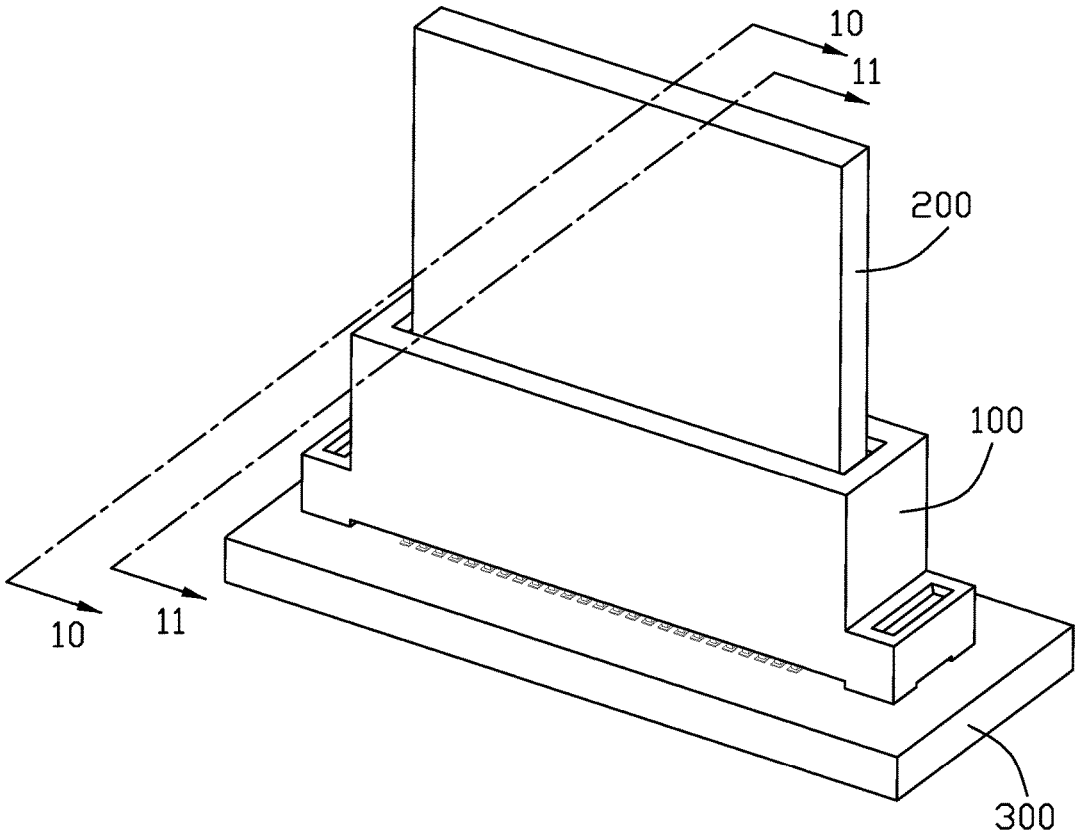
FIG. 1 is a perspective view of an electrical connector on the printed circuit board with the memory module therein according to one embodiment of the invention.
Figure 2:
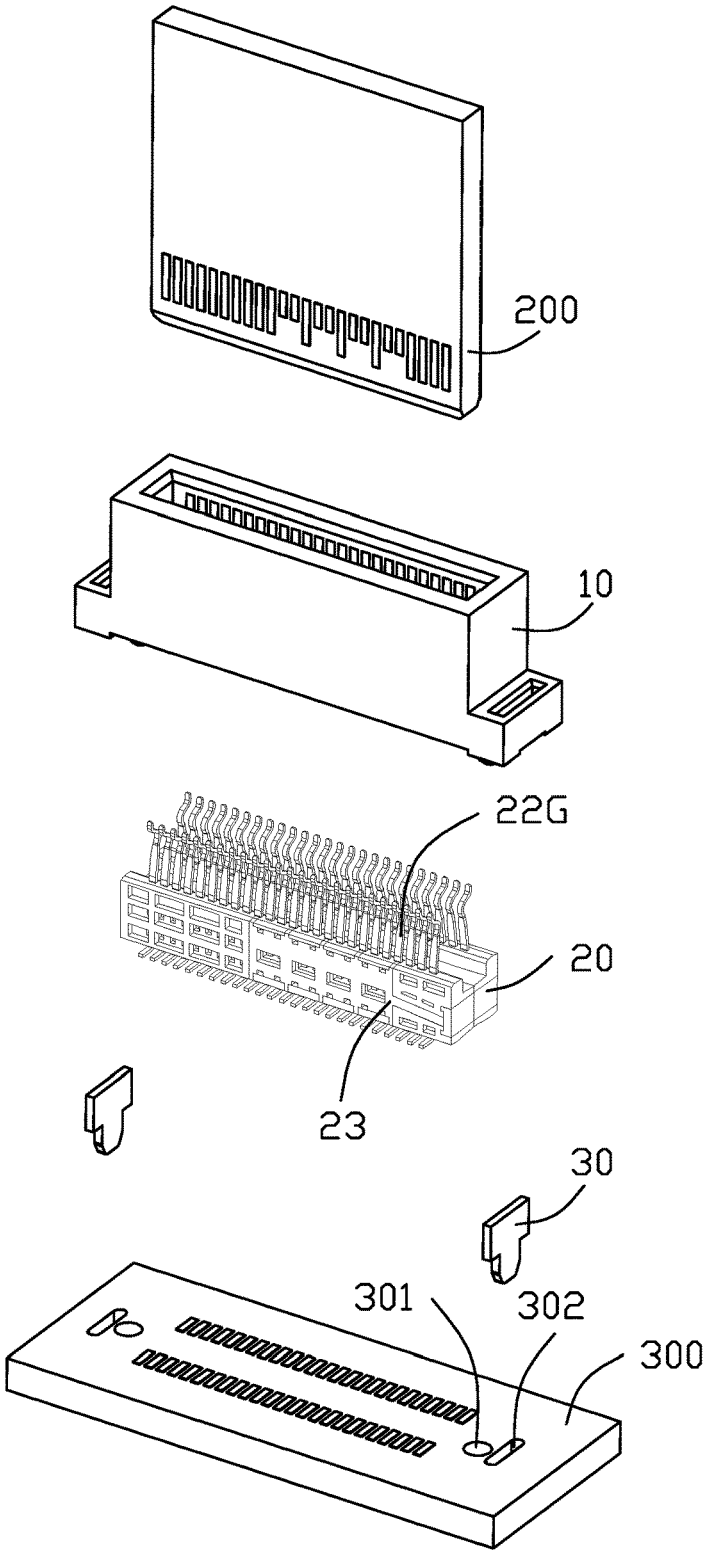
FIG. 2 is an exploded perspective view of the electrical connector, the printed circuit board and the memory module of FIG. 1.
Figure 3:
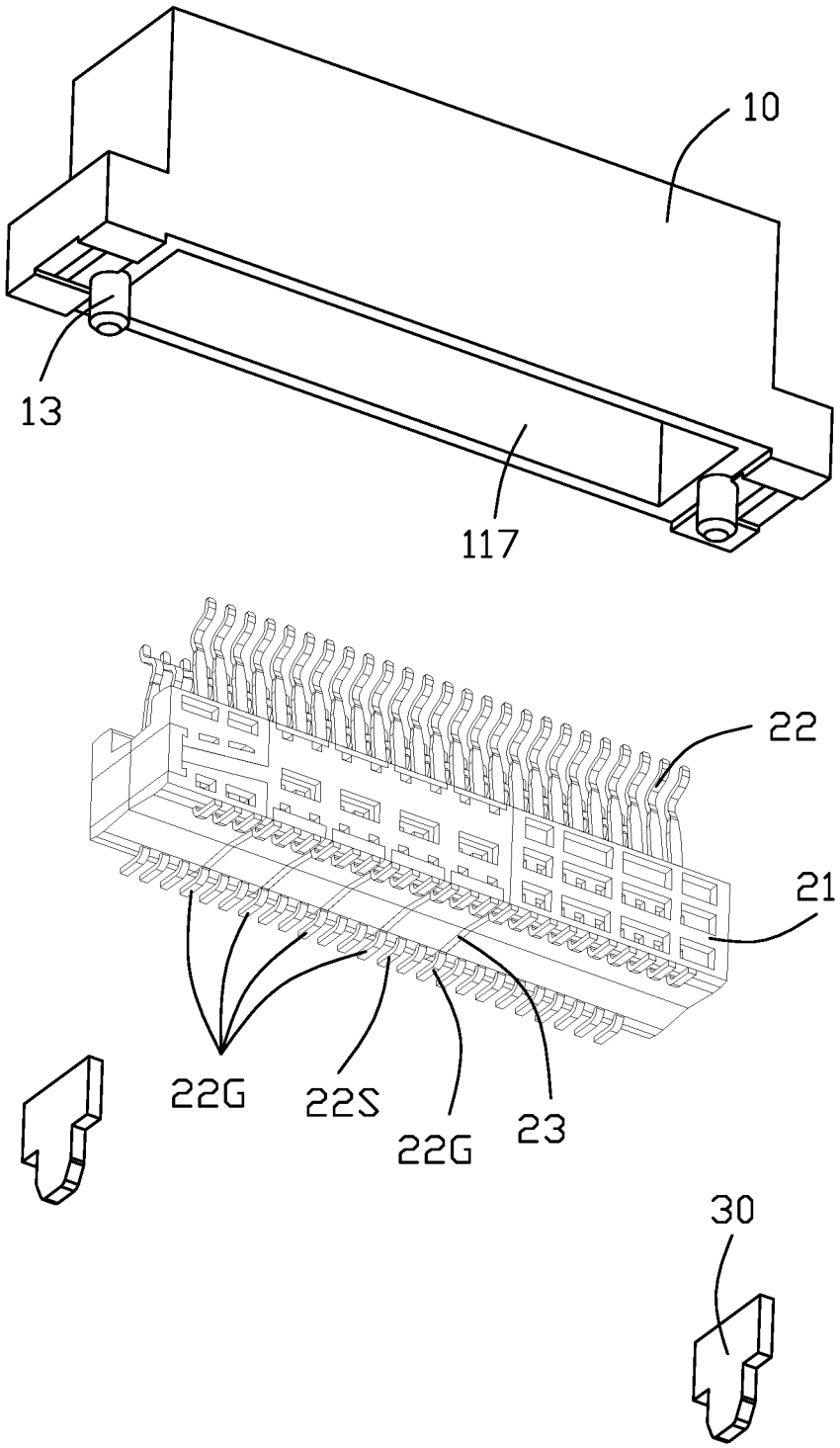
FIG. 3 is another exploded view of the electrical connector of FIG. 2.
Figure 4:
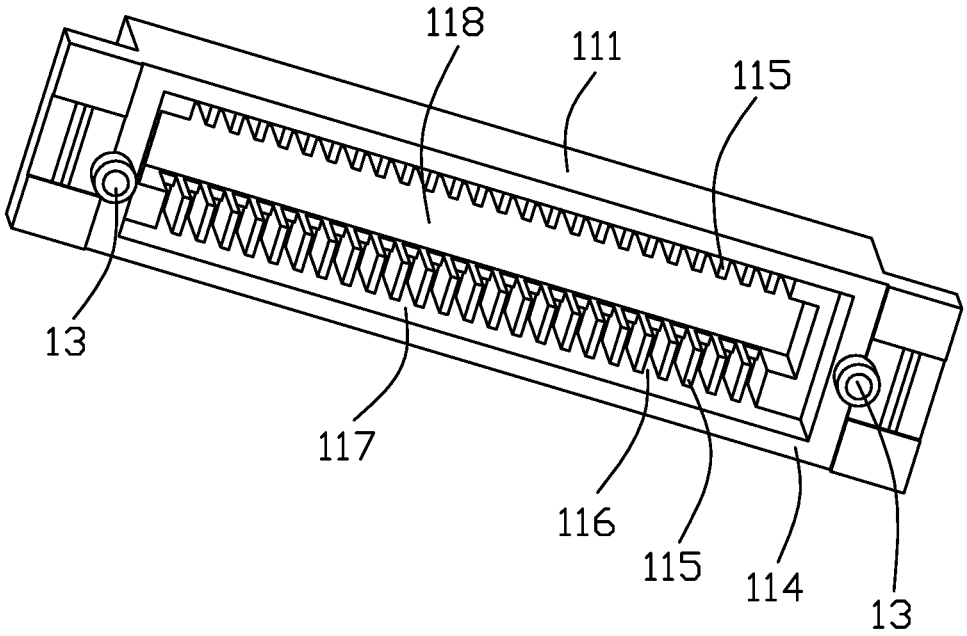
FIG. 4 is an upward perspective view of the housing of the electrical connector of FIG. 3.
Figure 5:
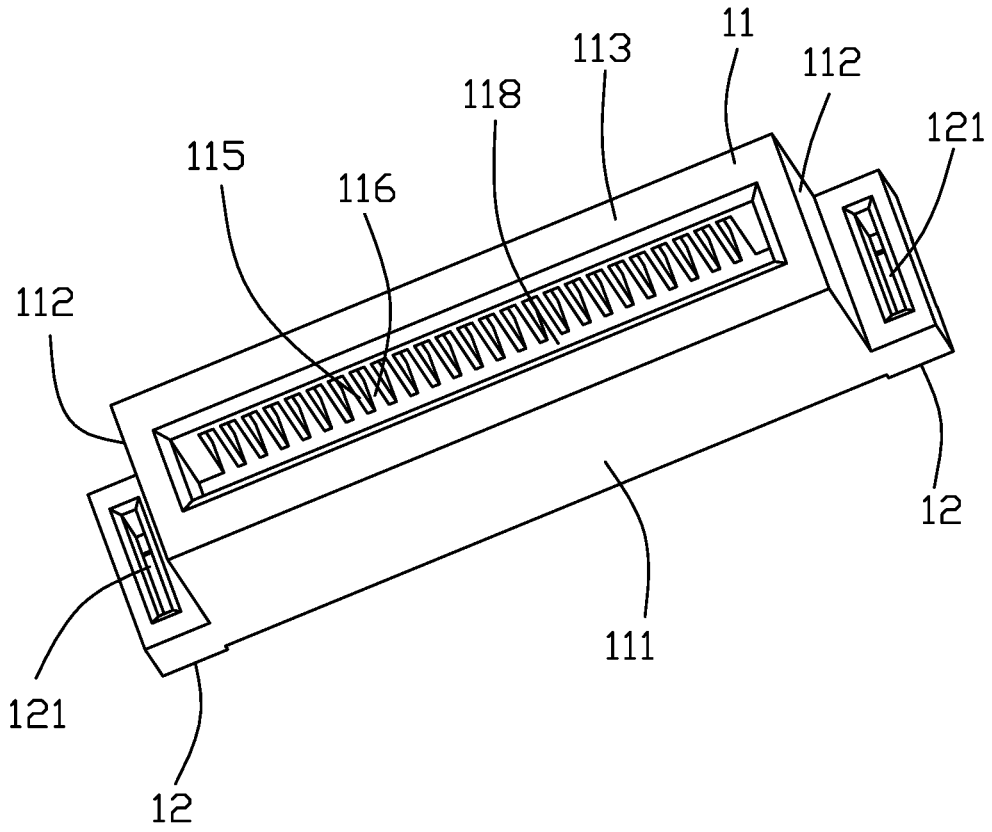
FIG. 5 is a downward perspective view of the housing of the electrical connector of FIG. 4.
Figure 6:
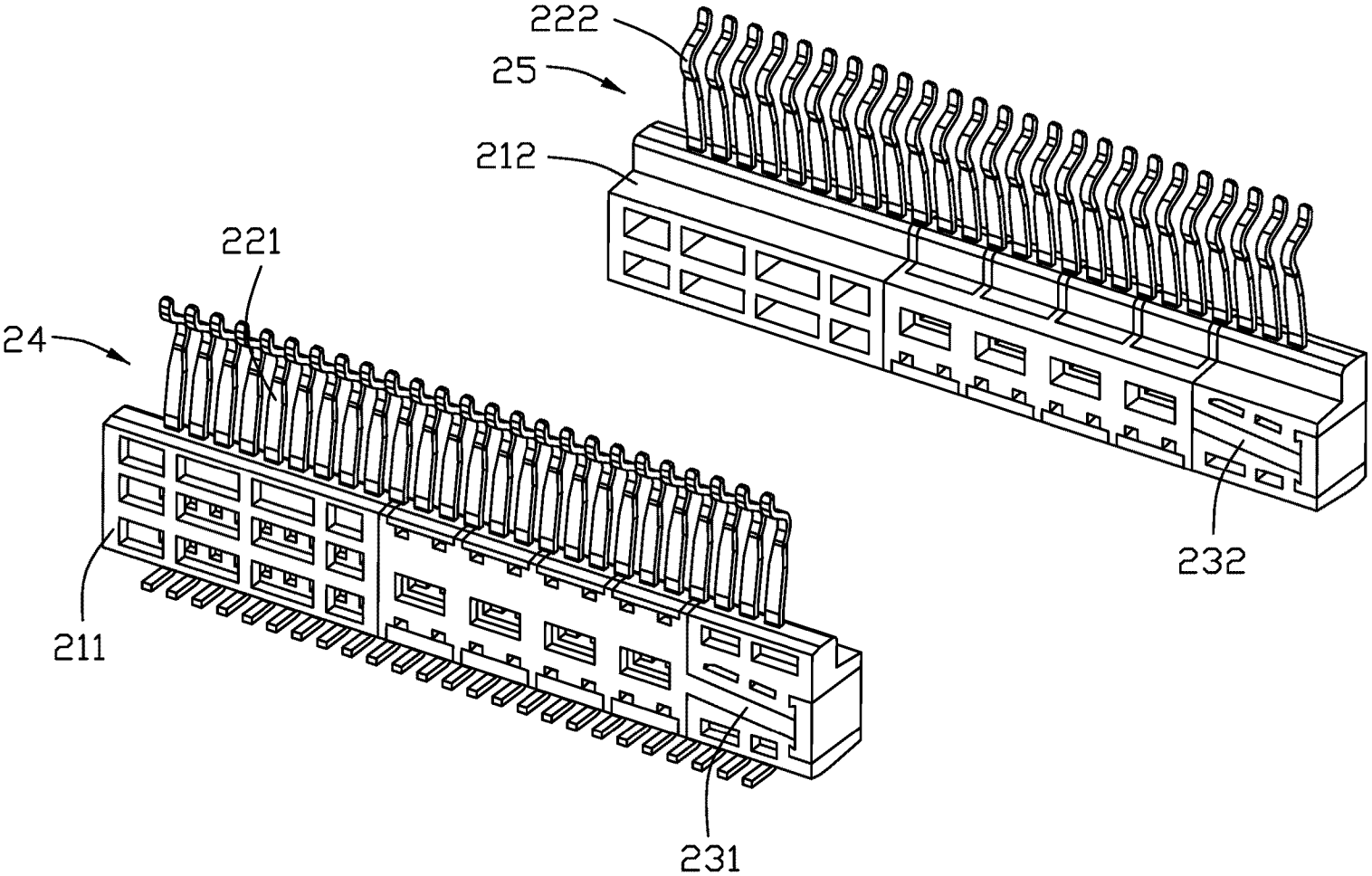
FIG. 6 is an exploded perspective of the contact module set of the electrical connector of FIG. 4.
Figure 7:
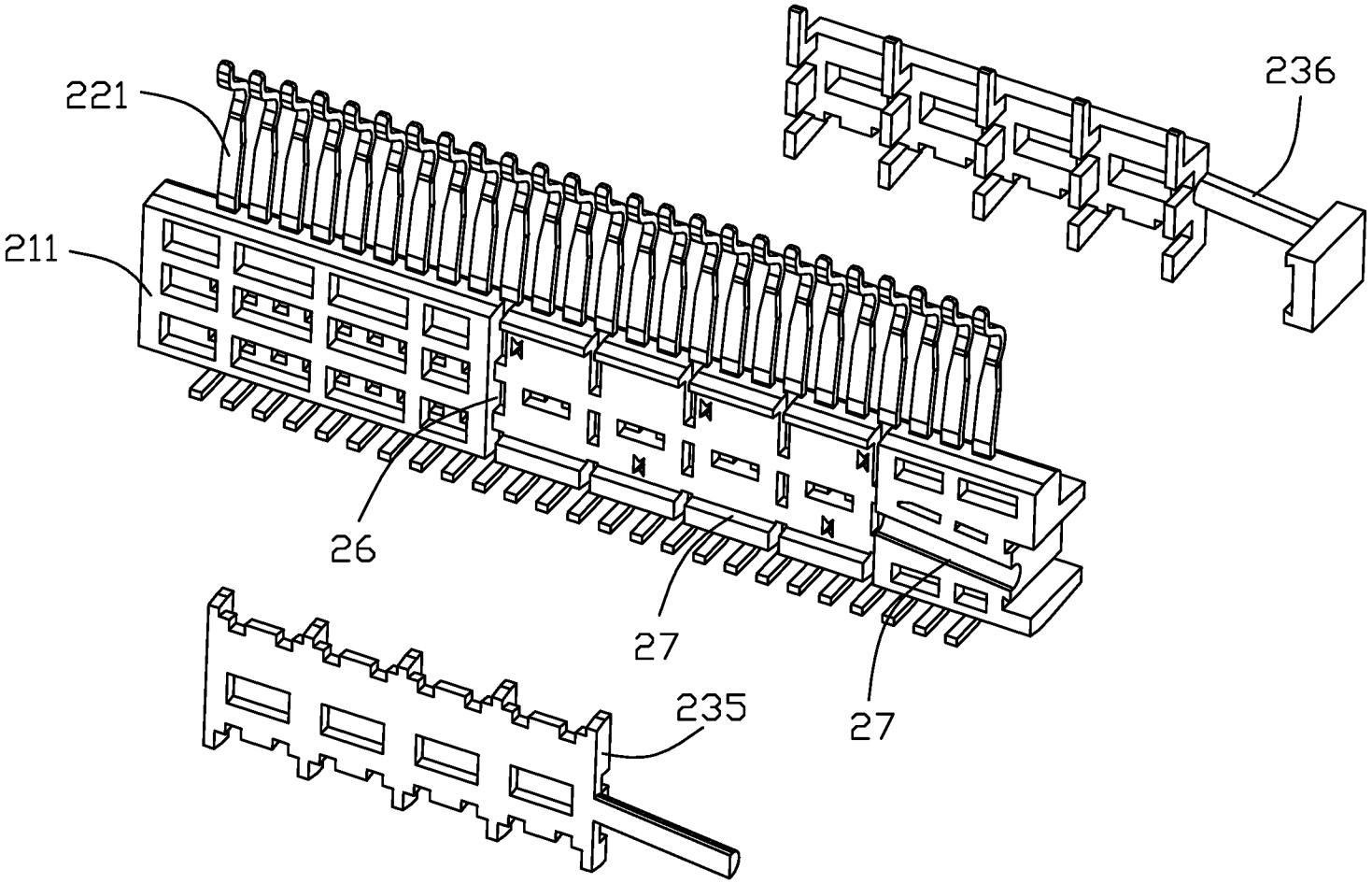
FIG. 7 is a further exploded view of the first contact module of the contact module set of the electrical connector of FIG. 3.
Figure 8:
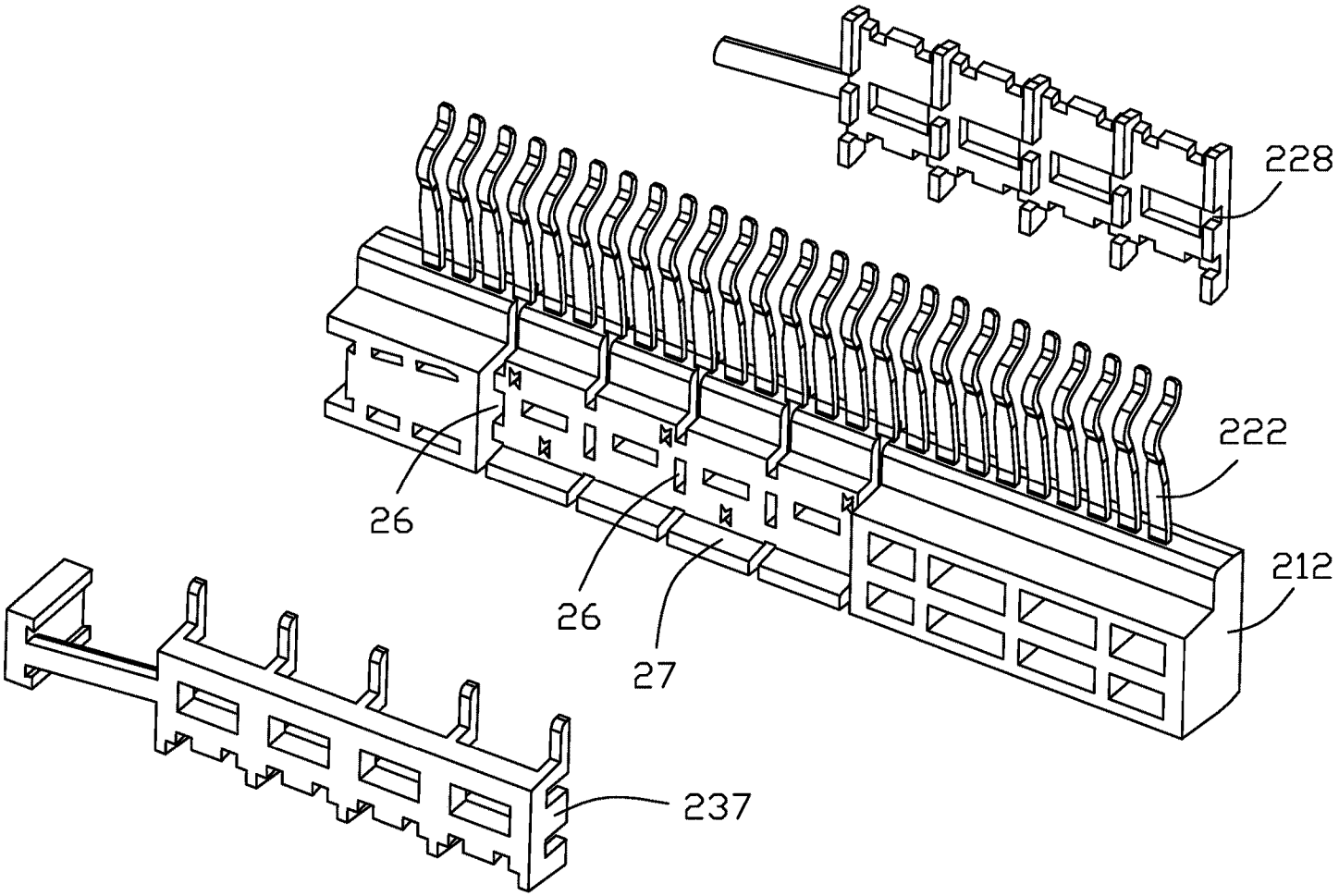
FIG. 8 is a further exploded view of the second contact module of the contact module set of the electrical connector of FIG. 7.

Reference will now be made in detail to the embodiments of the present disclosure. The embodiment will be shown in FIGS. 1 to 11. An electrical connector 100 connecting the memory module 200 and the printed circuit board 300. The connector 100 includes an insulative housing 10, a contact module set 20 assembled to the housing 100, and a pair of board locks 30.

The housing 10 includes a main body 11 and a pair of mounting regions 12 at two opposite ends in the longitudinal direction. The main body 11 includes a pair of side walls 111 extending along the longitudinal direction, and a pair of end walls 112 connected between opposite ends of the pair of side walls 111, a top face 113 and a bottom face 114 opposite to the top face 113. Each side wall 111 forms a plurality of ribs 115 and the corresponding contact passageways 116 alternately arranged with each other along the longitudinal direction. A mating slot 118 is formed between the ribs 115 in a transverse direction perpendicular to the longitudinal direction and extends through the top face 113. A receiving cavity 117 is located under the ribs 115 and extends through the bottom face 114. A width of the receiving cavity 117 is larger than that of the mating slot 118 in the transverse direction while the length of the receiving cavity 117 is similar to that of the mating slot in the vertical direction perpendicular to both the longitudinal direction and the transverse direction.

Each mounting section 12 forms a retention slot 121 to retain the corresponding board lock 30 therein. A pair of posts 131 extend downward from the bottom face 114. The printed circuit board 300 forms the holes 301 to receive the posts 131, and the holes 302 to receive the board locks 30.

The contact module set 20 is upwardly assembled into the housing 10, and includes an insulator 21 and a plurality of contacts 22 secured thereto. The insulator 21 is received within the receiving cavity 117 in an interference fit with the housing 10. The contacts 22 are received within the corresponding contact passageways 116, respectively. Each contact 22 includes a retaining section 225 secured to the insulator 21, a deflectable contacting section 226 extending from one end of the retaining section 225 into the mating slot 118, and a soldering section 227 extending from the other end of the retaining section 225 out of the housing 10. The contacting section 226 mechanically and electrically connects to the memory module 200, and the soldering section 227 is soldered upon the printed circuit board 300. The contacts include a plurality of signal contacts 22S and a plurality of grounding contacts 22G. The contact module set 20 further includes a conductive plastic 23 mechanically and electrically connected to the grounding contacts, respectively.

Figure 9:
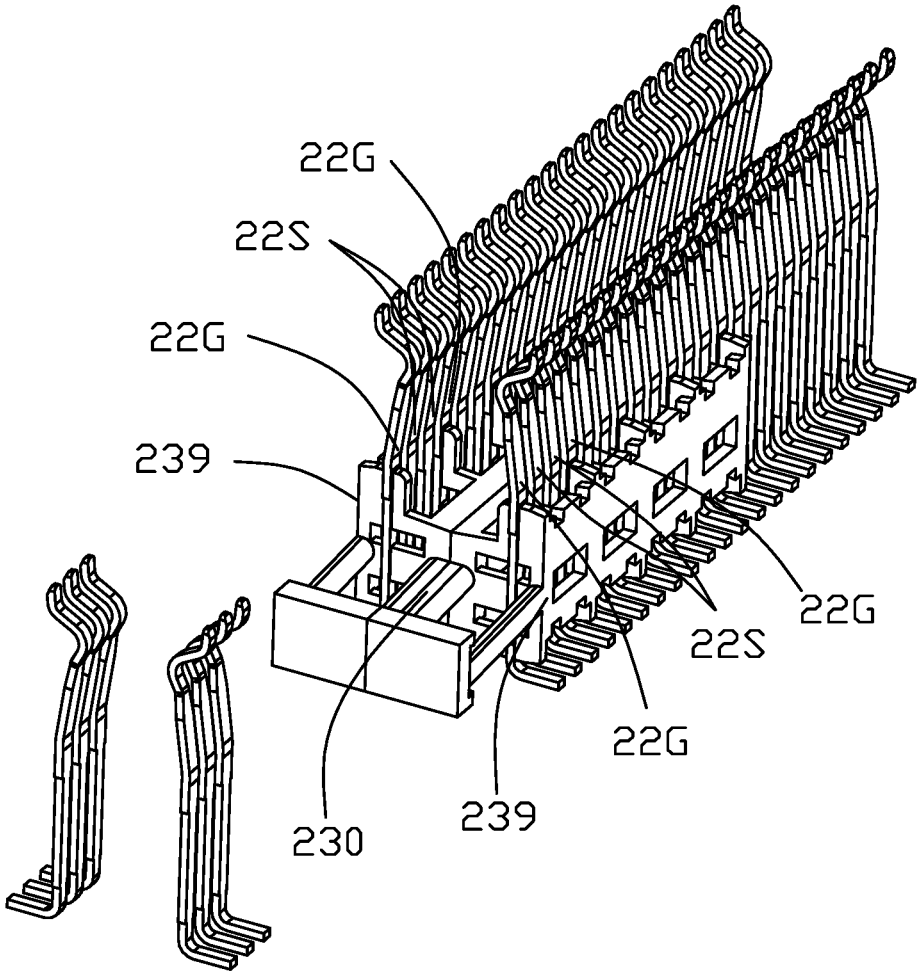
FIG. 9 is an assembled perspective view of the contact module set of the electrical connector of FIG. 3 without showing the insulators.
Figure 10:
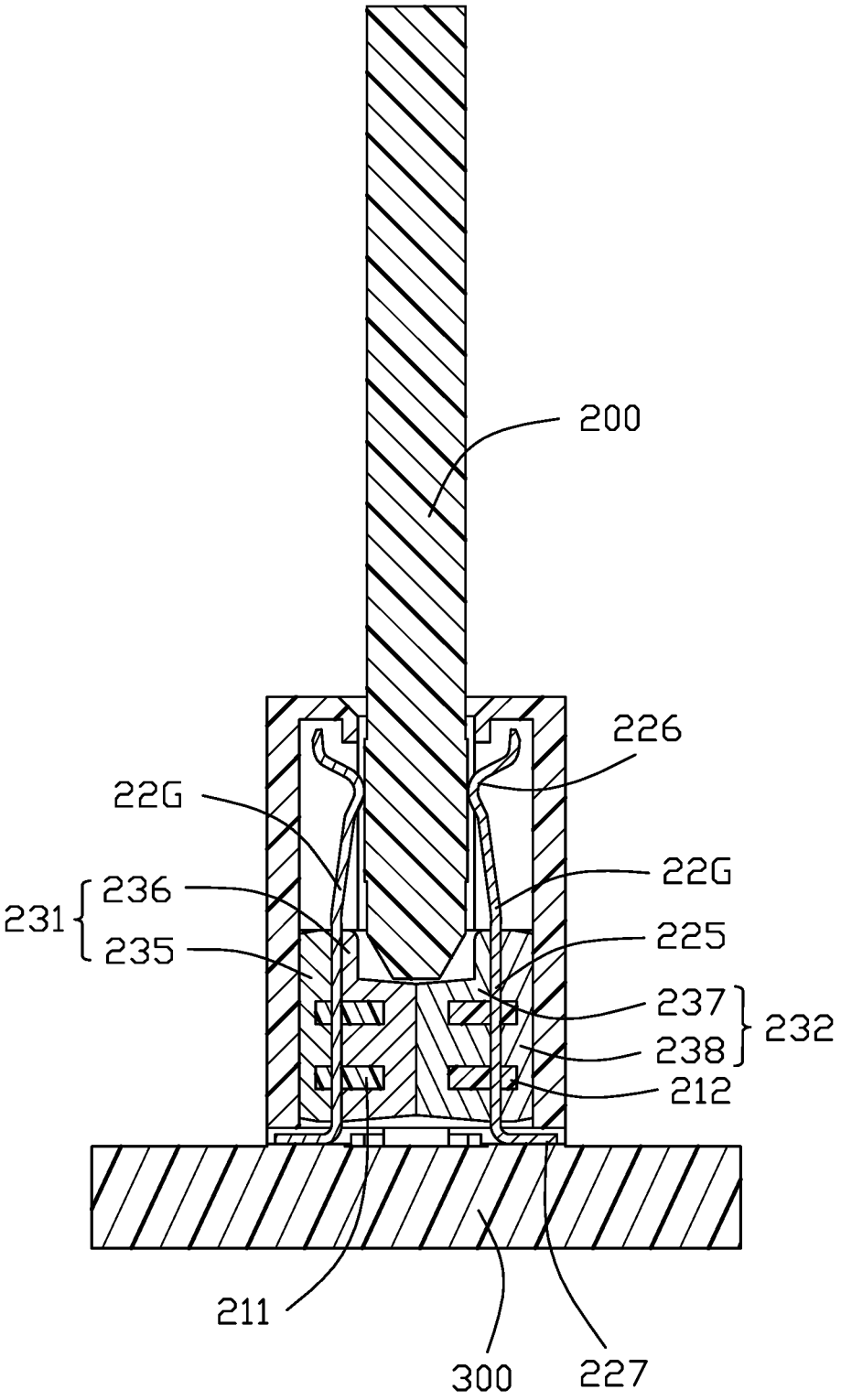
FIG. 10 is a cross-sectional view of the electrical connector of FIG. 1 along line 10-10.

As shown in FIG. 9, the conductive plastic 23 includes an inner part 230 to mechanically and electrically connect to the grounding contacts 22G and an outer part 239 to mechanically and electrically connect to the grounding contacts 22G. Therefore, each grounding contact 22G is essentially sandwiched between the inner part 230 and the outer part 239 in the transverse direction. In other words, each grounding contact 22 is essentially intimately and largely connected by the conductive plastic 23, thus enhancing the grounding/shielding effect.

The insulator 21 is composed of the first insulator 211 and the second insulator 212, the contacts 22 include first contacts 221 and second contacts 222, the conductive plastic 23 is composed of the first conductive plastic 231 and the second conductive plastic 232. The contact module set 20 is composed of the first contact module 24 and the second contact module 25 wherein the first connect module 24 includes the first insulator 211 with the first contacts 221 secured therein, and the second contact module 25 includes the second insulator 212 and the second contacts 222 secured therein.

The first contacts 221 are insert-molded within the first insulator 211, and the second contacts 222 are insert-molded within the second insulator 212. The first conductive plastic 231 is further over-molded upon the first insulator 211 so as to integrally mechanically and electrically connect to all the grounding contacts 22G of the first contacts 221. The first conductive plastic 231 is composed of the first/outer part 235 and the second/inner part 236 respectively located upon the inner surface and the outer surface of the first insulator 211 and mechanically and electrically connected to each other to form a loop. Similarly, the second conductive plastic 232 is further over-molded upon the second insulator 212 so as to integrally mechanically and electrically connect to all the grounding contacts 22G of the second contacts 222. The second conductive plastic 232 includes a first/inner part 237 and a second/outer part 238 respectively located upon the inner surface and the outer surface of the second insulator 212 and mechanically and electrically connected to each other to form a loop. The first contact module 24 and the second contact module 25 are stacked with each other in the transverse direction so as to have the first conductive plastic 231 and the second conductive plastic 232 electrically connected via the inner part 236 of the first conductive plastic 231 and the inner part 237 of the second conductive plastic 232, thus having the grounding contacts 22G of the first contacts 221 and those of the second contacts 222 connected together to form a loop. Notably, the conductive plastic 23 is over-molded/insert-molded upon the contact module set 20, thus enhancing electrical and mechanical connection between the conductive plastic 23 and the grounding contacts 22 and reinforcing integrity of the whole connector.

Figure 11:
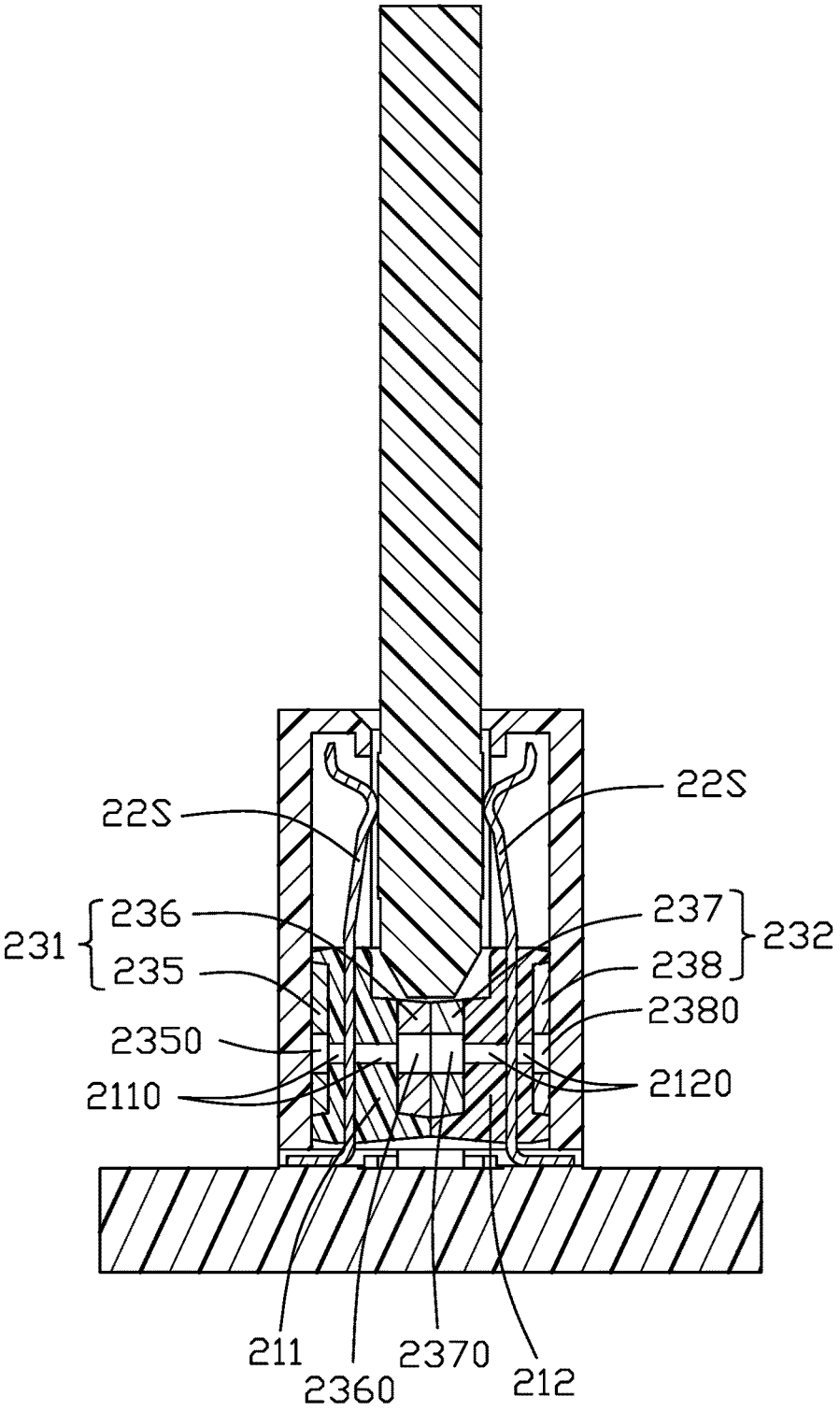
FIG. 11 is a cross-sectional view of the electrical connector of FIG. 1 along line 11-11.

The first insulator 211 and the second insulator 212 originally form the corresponding spaces 26 which are later filed with the first conductive plastic 231 and the second conductive plastic 232. The first insulator 211 and the second insulator 212 further form the spaces 27 communicating with the spaces 26 for commonly forming the first conductive plastic 231 and the second conductive plastic 232. As shown in FIG. 11, the outer part 235 forms a through hole 2350, the first insulator 211 forms a through hole 2110, and the inner part 236 forms a through hole 2360 in an aligning manner so as to expose the corresponding signal contact 22S of the first contact 221. Similarly, the outer part 238 forms a through hole 2380, the second insulator 212 forms a through hole 2120, and the inner part 237 forms a through hole 2370 in an aligning manner to expose the corresponding signal contact 22S of the second contact 222 for impedance consideration. One feature of the invention is to have the conductor plastic mechanically and electrically connect to the corresponding grounding contact 22G with a sufficient length along the length direction of the contact instead of the single point thereof so as to maximize the contacting area between the grounding contact and the conductive plastic. In addition, the inner part and the outer part of the conductive plastic respectively contact opposite surfaces of the grounding contact compared with the one side contact performed by the traditional design. Notably, in the invention the contact area between the conductive plastic and the corresponding grounding contact is maximized so as to leave only two spaced positions of the insulator securing the retaining section of the grounding contact. Anyhow, the conductive plastic also provides the retention with regard to the corresponding grounding contact due to the molding process.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing extending along a longitudinal direction and defining a lower receiving cavity and an upper mating slot in a vertical direction perpendicular to said longitudinal direction;

a contact module set received within the receiving cavity and including an insulator extending along the longitudinal direction and a plurality of contacts secured therein via insert-molding, the contacts including a plurality of signal contacts and a plurality of grounding contacts;

a conductive plastic further attached upon the insulator via an over-molding process to intimately mechanically and electrically connect to each corresponding grounding contact with a length along a length direction of each corresponding grounding contact;

wherein the conductive plastic includes an inner part and an outer part commonly sandwiching each corresponding grounding contact therebetween in a transverse direction perpendicular to both said longitudinal direction and said vertical direction;

wherein the conductive plastic forms a through hole, and the insulator forms another through hole aligned with said through hole in the transverse direction.

2. The electrical connector as claimed in claim 1, wherein each of said contacts including a retaining section secured to the insulator, and the retaining section of each corresponding grounding contacts is sandwiched between the inner part and the outer part.

3. The electrical connector as claimed in claim 1, wherein the inner part and the outer part are mechanically and electrically connected to each other.

4. The electrical connector as claimed in claim 1, wherein the contact module set includes a first contact module and a second contact module each having the corresponding insulator and contacts secured therein, the inner part of the first contact module is stacked with the inner part of the second contact module in the transverse direction.

5. The electrical connector as claimed in claim 1, wherein said conductive plastic extends in the longitudinal direction corresponding to the corresponding grounding contacts.

6. The electrical connector as claimed in claim 1, wherein each corresponding grounding contacts are retained by the insulator in the transverse direction at two positions spaced from each other in the vertical direction.

7. The electrical connector as claimed in claim 1, wherein the housing forms a plurality of contact passageways above the receiving cavity and beside the mating slot, and each of said contacts includes a deflectable contacting section received within the corresponding contact passageway and further extending into the mating slot.

8. An electrical connector comprising:

an insulative housing extending along a longitudinal direction and defining opposite upper mating slot and lower receiving cavity in a vertical direction perpendicular to said longitudinal direction;

a contact module set received within the receiving cavity and including a first contact module and a second contact module stacked with each other in a transverse direction perpendicular to both said longitudinal direction and the vertical direction, each of said first contact module and said second contact module including an insulator and a plurality of contacts integrally secured therein via insert-molding, said contacts including signal contacts and grounding contacts; wherein each of said first contact module and said second contact module further includes a conductive plastic having an inner part and an outer part commonly sandwiching corresponding grounding contacts therebetween in the transverse direction.

9. The electrical connector as claimed in claim 8, wherein the inner part and the outer part of each conductive plastic are mechanically and electrically connected to each other to form a loop.

10. The electrical connector as claimed in claim 9, wherein the inner part of the first contact module and the inner part of the second contact module are stacked with each other in the transverse direction to form another loop.

11. The electrical connector as claimed in claim 9, wherein in each of said first contact module and said second contact module, the inner part forms a first through hole in the transverse direction, the insulator forms a second through hole in the transverse direction, and the outer part forms a third through hole in the transverse direction, said all said first, second and third through holes are aligned with one another in the transverse direction for exposing one corresponding signal contact.

12. A method of making an electrical connector comprising steps of:

providing an insulative housing with an upper mating slot and a lower receiving cavity in a vertical direction;

providing a contact module set with an insulator and a plurality of contacts secured therein via insert-molding, said contacts including signal contacts and grounding contacts;

applying a conductive plastic upon the insulator via overmolding to not only secure the conductive plastic upon the insulator for reinforcing the contact module set but also mechanically and electrically connect to the corresponding grounding contacts and retain the corresponding grounding contacts in position;

wherein the conductive plastic sandwiches the corresponding grounding contacts in a transverse direction perpendicular to the vertical direction;

wherein the contact area between the conductive plastic and the corresponding grounding contact extends a length along a length direction of the corresponding grounding contact, and said length is not less than one half of a retaining section of each of the contacts in said contact module set in the vertical direction.

13. The method as claimed in claim 12, wherein the contact module set includes a first contact module and a second contact module stacked with each other in the transverse direction.

14. The method as claimed in claim 13, wherein the plastic conductive in each of said first contact module and said second contact module has an inner part and an outer part commonly sandwiching the corresponding grounding contacts therebetween in the transverse direction.

15. The method as claimed in claim 14, wherein the inner part and the outer part are mechanically and electrically connected to each other.

* * * * *